US007152740B1

(12) United States Patent
Chang

(10) Patent No.: US 7,152,740 B1
(45) Date of Patent: Dec. 26, 2006

(54) PACKAGING AND DISPLAY BOX FOR A CIRCULAR PRODUCT

(76) Inventor: Lin-Chun Chang, No. 100, Guanghuei St., South District, Taichung City 402 (TW)

( * ) Notice: Subject to any disclaimer, the term of this patent is extended or adjusted under 35 U.S.C. 154(b) by 0 days.

(21) Appl. No.: 11/305,321

(22) Filed: Dec. 19, 2005

(51) Int. Cl.
*B65D 5/50* (2006.01)

(52) U.S. Cl. ..... 206/764; 206/526; 206/762

(58) Field of Classification Search ..... 206/303, 206/446, 503, 508, 509, 525, 526, 527, 741, 206/743, 756, 764, 769, 775, 781, 782
See application file for complete search history.

(56) References Cited

U.S. PATENT DOCUMENTS 2,926,781 A * 3/1960 Dickhens et al. ..... 206/526
4,905,822 A * 3/1990 Bosco ..... 206/775
6,050,420 A * 4/2000 Green ..... 206/764
2002/0088736 A1* 7/2002 Liu ..... 206/526

* cited by examiner

*Primary Examiner*—Luan K. Bui
(74) *Attorney, Agent, or Firm*—Charles E. Baxley

(57) ABSTRACT

A packaging and display box for a circular product comprises a box body, a plurality of supporting members, a sliding board and a guiding board. In the lateral sides of the box body are formed observing holes and an output hole. In the top surface of the box body is formed an input hole, at each corner of the box body is installed a supporting member for improving the structural strength and carrying capacity of the box. At the upper edge of the output hole is installed a supporting beam, protecting the products from crush damage. The slant sliding board inside the box body and the guideways of the guiding board enable the circular products to slide automatically to the output hole, and the circular products can be separated and arranged in arrays, saving the time for tidying up. Furthermore, the packaging and display boxes can be stacked or transported directly, reducing the storage space of many shops.

12 Claims, 4 Drawing Sheets

PACKAGING AND DISPLAY BOX FOR A CIRCULAR PRODUCT

BACKGROUND OF THE INVENTION

1. Field of the Invention

The present invention relates to a packaging and display box for a circular product, and more particularly to a box for packing and displaying circular products.

2. Description of the Prior Art

Usually, different structures should be used when packaging, transporting, and displaying different products. Each of the conventional packaging box, transportation box and display box only has a single function, the operation for the conventional box is described as follows:

When packaging products, the user will put the products in arrays into a paper packaging box and seal it, making it convenient for storage.

When stacking and transporting the packaging box, the products in the packaging box is very heavy, plus the paper box doesn't have enough supporting strength, usually, the user can't stack several boxes together and transport them directly. Therefore, it is necessary to make shelves on the truck, and the shelves have to be transported, along with the products, to the buyer, the shopping mall, etc. The buyer or the shopping also has to arrange storage shelves in their storage space, such that a great number of packaging boxes can be stored. Furthermore, after the packaging boxes are removed from the storage shelves, the shelves will still take up a lot of space.

When displaying the products in a shopping mall, the user has to put the products on the display shelf one by one, and has to rearrange (an empty space will appear after the consumer takes away the outermost products) the products on the shelves, it is not beauty and is inconvenient for the user to take the products and for the seller to count the products.

Therefore, each of the conventional packaging box, the display shelf or the storage shelf only has a single function, it is impossible to utilize the space effectively and reduce the cost. Thereby, how to make a multifunctional box that can replace the packaging box, the display shelf and the storage shelf, is the chief problem the R&D personnel and the manufacturer want to solve.

The present invention has arisen to mitigate and/or obviate the afore-described disadvantages.

SUMMARY OF THE INVENTION

The primary objective of the present invention is to provide a packaging and display box for a circular product.

In the lateral sides of the box body of the present invention are defined with a plurality of observing holes for enabling the user to clearly recognizing the products stored in the box body. The output hole and the input hole can be used to bring the display function of the box body into full play. At the corners of the box body are arranged supporting members for improving the carrying capacity and structural strength of the box body. The present invention can allow the packaging and display boxes to be stacked or transported directly, reducing the necessary storage space of many shops.

Another importance objective of the present invention is to provide a display box.

By using the slant sliding board inside the box body and the guideways of the guiding board, the present invention can enable the circular products to slide automatically to the output hole, and the circular products will be separated clearly and arranged in arrays, thus saving the time for tidying up. After the first circular product is taken away by the consumer, the next circular product following the first circular product will slide to the forefront of the output hole automatically, so that the consumer can fetch it conveniently without the risk of knocking over the neighboring products.

The present invention will become more obvious from the following description when taken in connection with the accompanying drawings, which show, for purpose of illustrations only, the preferred embodiment in accordance with the present invention.

DETAILED DESCRIPTION OF THE PREFERRED EMBODIMENT

Figure 1:
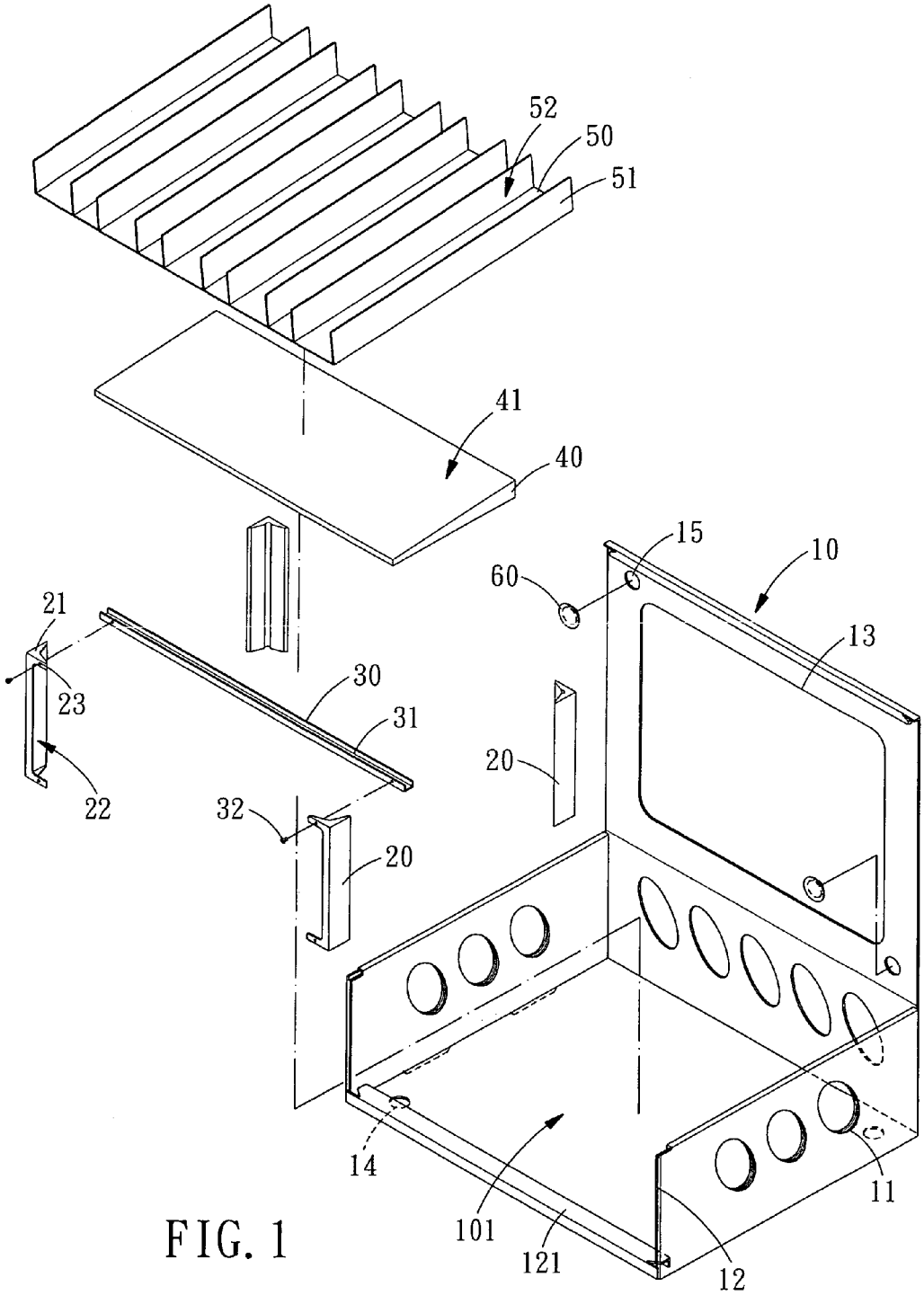
FIG. 1 is an exploded view of a packaging and display box for a circular product in accordance with a preferred embodiment of the present invention.
Figure 2:
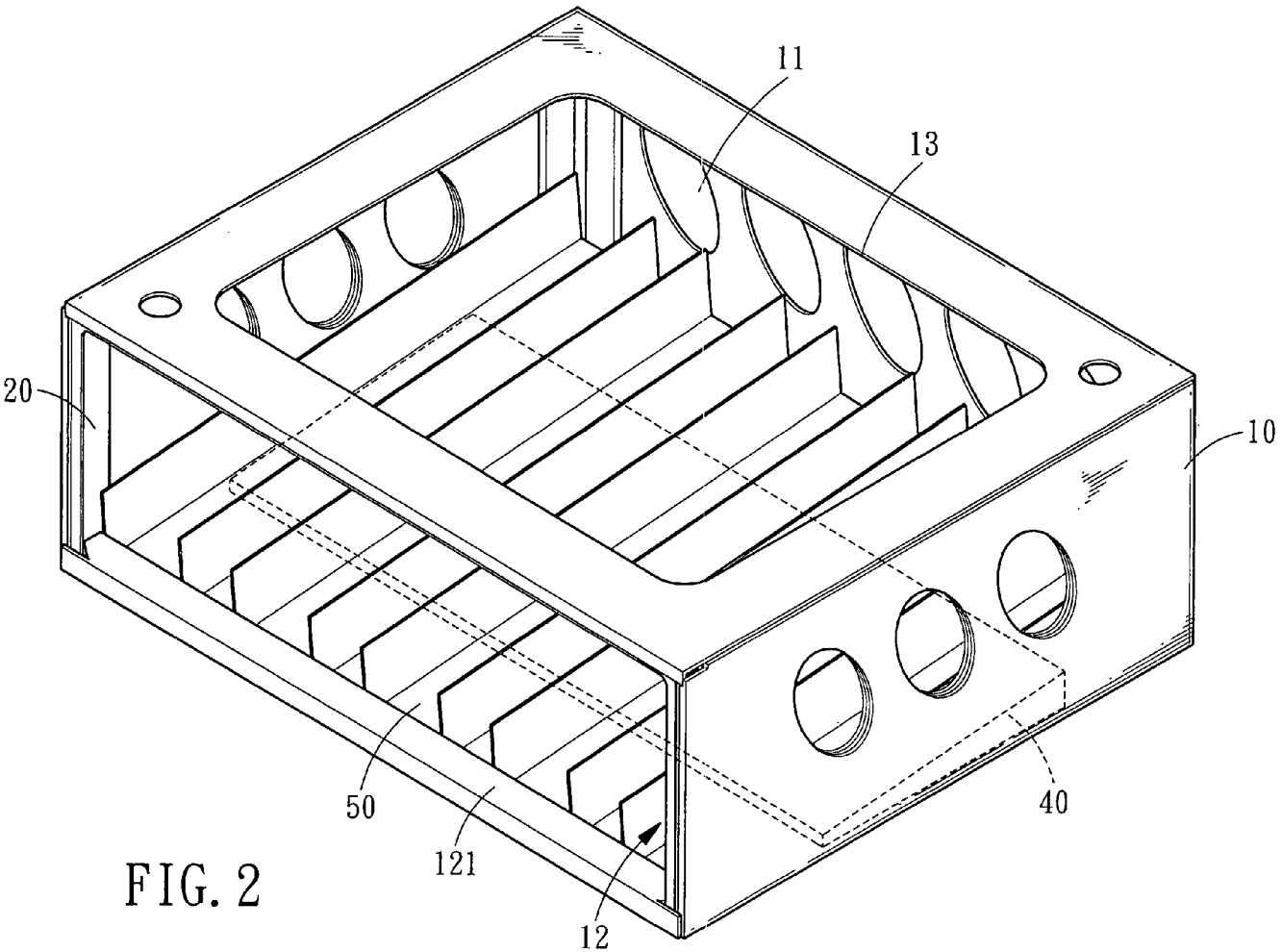
FIG. 2 is a perspective view of the packaging and display box for a circular product in accordance with the preferred embodiment of the present invention.

Referring to FIGS. 1 and 2, a packaging and display box for a circular product in accordance with a preferred embodiment of the present invention is shown and comprises:

A box body 10 is a rectangular paper box having six surfaces and a receiving space 101, in each of the lateral sides (except the front side) of the box body 10 are formed a plurality of circular observing holes 11, and in the front side of the box body 10 is defined a discharging hole 12. A flange 121 is formed at the lower edge of the discharging hole 12, in the top surface of the box body 10 is formed a rectangular input hole 13. At a corner of the rectangular input hole 13 is formed at least an upper positioning hole 15, and in the bottom surface of the box body 10 is correspondingly formed a lower positioning hole 14.

Four supporting members 20 are vertical rod-like metal elements having a triangular cross section and are positioned at four corners of the box body 10. At either end of each of the supporting members 20 is defined a supporting surface 21 for supporting the top and bottom surfaces of the box body 10, thus improving the carrying capacity and structural strength of the box body 10. In a lateral side of each of the supporting members 20 is formed an arc space 22 located correspondingly to the output hole 12 of the box body 10, and in the upper edge of the respective supporting members 20 is further defined a locking hole 23 located correspondingly to the output hole 12 of the box body 10.

A supporting beam 30 is a comparatively thin metal beam having a reverse U-shaped cross section, at either end of the supporting beam 30 is formed a locking hole 31 through which a locking member 32 is inserted into the locking hole 23 in the upper edge of the supporting members 20, so that the supporting beam 30 is installed on the upper edge of the output hole 12 of the box body 10.

A sliding board 40 is formed on the top surface thereof with a slant surface 41 inclined toward the output hole 12 of the box body 10, and the sliding board 40 is positioned at the bottom of the receiving space 101 of the box body 10.

A guiding board 50 is arranged on the top surface thereof with a plurality of paper bars 51 for dividing the top surface into equal-sized or different-sized guideways 52 (such as 1.5 inch, 2 inch, 2.5 inch, etc), the guiding board 50 is positioned at the bottom of the receiving space 101 of the box body 10 and stacked on the slant surface 41 of the sliding board 40.

Two protruding covers 60 are positioned in the upper positioning holes 15 (in the top surface of the box body 10 and each has a protruding portion 61 that protrudes out of the upper positioning holes 15. The protruding portion 61 is sized correspondingly to the lower positioning holes 14 of the box body 10.

Figure 3:
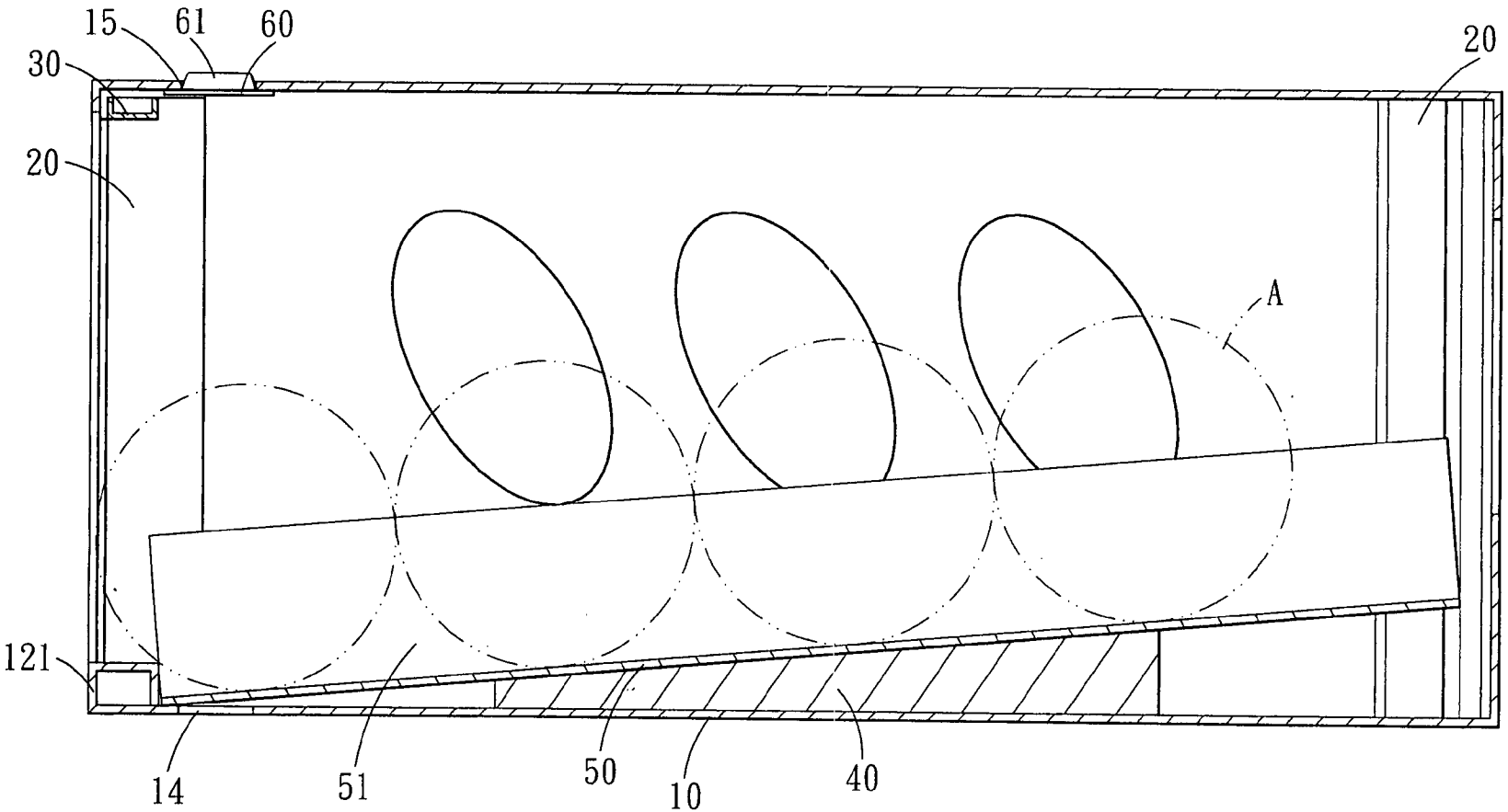
FIG. 3 is a cross sectional view of the packaging and display box for a circular product in accordance with the preferred embodiment of the present invention.

For a better understanding of the embodiment, reference should be made to FIGS. 1–3.

As shown in the drawing, in the lateral sides of the box body 10 are formed a plurality of observing holes 11 for enabling the user to see the circular products A arranged in the receiving space 101 of the box body 10. The output hole 12 and the input hole 13 can bring the display function of the box body 10 into full play, the consumer can observe the circular products A from outside the box at any time. With the aid of the slant surface 41 of the sliding board 40 in the box body 10, plus the guideways 52 of the guiding board 50, the circular products A will roll automatically forward to the output hole 12, and the circular products A will fall into the guideways 52 and arranged in arrays automatically by their own weight. The circular products A, under the effect of weight, will slide along the slant surface 41 of the sliding board 40 and stops at the forefront of the output hole 12. After the first circular product A is taken away by the consumer, the next circular product A following the first circular product A will slide to the forefront of the output hole 12 automatically, so that the consumer can fetch it conveniently without the problem of the conventional display box that the neighboring products will likely be knocked over.

The function of the present invention is best illustrated in the below description by referring to FIG. 4, since the user has to disassemble, assemble, stack or display the box body 10 frequently, the four supporting members 20 are installed at the four corners of the box body 10, and at both ends of the respective supporting members 20 is defined a supporting surface 21 for supporting the top and bottom surfaces of the box body 10, thus improving the carrying capacity and structural strength of the box body 10 (the carrying capacity of this embodiment is up to 800 Kgs). In addition, the supporting beam 30 is installed on the upper edge of the output hole 12 of the box body 10 as a supporting structure, utilizing the supporting beam 30 and the two supporting members 20 to improve the structural strength of the box body 10 and the output hole 12. Therefore, the bearing capacity is great enough when the boxes of the present invention are stacked one on top of another, the present invention can allow the packaging and display boxes to be stacked or transported directly, reducing the necessary storage space of many shops.

Figure 4:
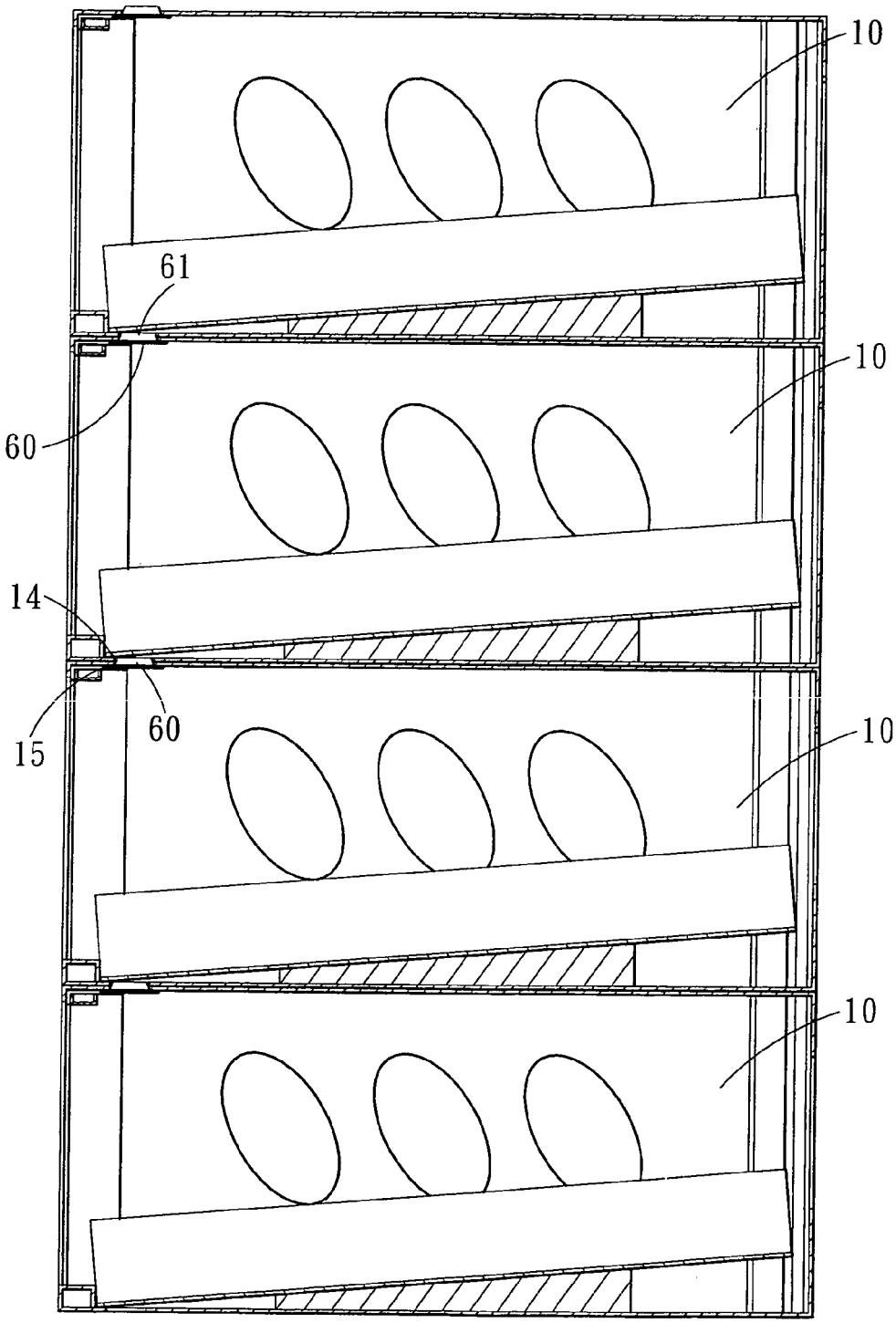
FIG. 4 is a cross sectional view in accordance with the preferred embodiment of the present invention, of showing that plural box bodies are being stacked one on top of another.

On the other hand, FIG. 4 also clearly discloses the function of the two protruding covers 60, the protruding covers 60 are positioned in the upper positioning holes 15 in the top surface of the box body 10 and each has a protruding portion 61 that protrudes out of the upper positioning holes 15. The protruding portion 61 is sized correspondingly to the lower positioning holes 14 of the box body 10, such that when a plurality of box bodies 10 are stacked one on top of another, they still can be positioned stably and precisely.

While we have shown and described various embodiments in accordance with the present invention, it should be clear to those skilled in the art that further embodiments may be made without departing from the scope of the present invention.

What is claimed is:

1. A packaging and display box for a circular product comprising:

a box body interiorly formed with a receiving space, in each of lateral sides, except front side, of the box body formed a plurality of circular observing holes, in the front side of the box body defined an output hole, a flange formed at a lower edge of the output hole, in a top surface of the box body formed a rectangular input hole;

four supporting members being in the form of a vertical rod-like metal element positioned at four corners of the box body, at either end of each of the supporting members defined a supporting surface for supporting a top surface and a bottom surface of the box body;

at least a sliding board formed on a top surface thereof with a slant surface inclined toward the output hole of the box body, the sliding board being positioned at a bottom of the receiving space of the box body; and at least a guiding board having a plurality of guideways, the guiding board being positioned in the receiving space of the box body and stacked on the slant surface of the sliding board.

2. The packaging and display box for a circular product as claimed in claim 1, wherein at least one upper positioning hole is defined at a corner of the input hole of the box body, and at least one lower positioning hole is formed in the bottom surface of the box body, two protruding covers are positioned in the upper positioning hole in the top surface of the box body and each has a protruding portion that protrudes out of the upper positioning hole, the protruding portion is sized correspondingly to the lower positioning hole of the box body.

3. The packaging and display box for a circular product as claimed in claim 1, wherein an arc space is formed in a lateral side of each of the supporting members and located correspondingly to the output hole of the box body.

4. The packaging and display box for a circular product as claimed in claim 1, wherein at least a supporting beam is positioned on an upper edge of two supporting members and located on an upper edge of the output hole of the box body.

5. The packaging and display box for a circular product as claimed in claim 2, wherein at least a supporting beam is positioned on an upper edge of two supporting members and located on an upper edge of the output hole 12 of the box body.

6. The packaging and display box for a circular product as claimed in claim 3, wherein at least a supporting beam is positioned on an upper edge of two supporting members and located on an upper edge of the output hole 12 of the box body.

7. The packaging and display box for a circular product as claimed in claim 4, wherein each of the four supporting members is a vertical rod-like metal element having a triangular cross section, in the upper edge of the respective supporting members is defined a locking hole located correspondingly to the output hole of the box body, at either end of the supporting beam is formed a locking hole through which a locking member is inserted into the locking hole in the upper edge of the supporting members, so that the supporting beam is installed on the upper edge of the output hole of the box body.

8. The packaging and display box for a circular product as claimed in claim 5, wherein each of the four supporting members is a vertical rod-like metal element having a triangular cross section, in the upper edge of the respective supporting members is defined a locking hole located correspondingly to the output hole of the box body, at either end of the supporting beam is formed a locking hole through which a locking member is inserted into the locking hole in the upper edge of the supporting members, so that the supporting beam is installed on the upper edge of the output hole of the box body.

9. The packaging and display box for a circular product as claimed in claim 6, wherein each of the four supporting members is a vertical rod-like metal element having a triangular cross section, in the upper edge of the respective supporting members is defined a locking hole located correspondingly to the output hole of the box body, at either end of the supporting beam is formed a locking hole through which a locking member is inserted into the locking hole in the upper edge of the supporting members, so that the supporting beam is installed on the upper edge of the output hole of the box body.

10. The packaging and display box for a circular product as claimed in claim 7, wherein the box body is a rectangular paper box having six surfaces, each of the supporting members is a vertical rod-like metal element having a triangular cross section, and the supporting beam is a comparatively thin metal beam having a reverse U-shaped cross section.

11. The packaging and display box for a circular product as claimed in claim 8, wherein the box body is a rectangular paper box having six surfaces, each of the supporting members is a vertical rod-like metal element having a triangular cross section, and the supporting beam is a comparatively thin metal beam having a reverse U-shaped cross section.

12. The packaging and display box for a circular product as claimed in claim 9, wherein the box body is a rectangular paper box having six surfaces, each of the supporting members is a vertical rod-like metal element having a triangular cross section, and the supporting beam is a comparatively thin metal beam having a reverse U-shaped cross section.

* * * * *